United States Patent [19]

Belisle

[11] Patent Number: 4,785,960

[45] Date of Patent: Nov. 22, 1988

[54] MAILBOX SECURITY BAG

[76] Inventor: Brice Belisle, 36 Powers St., Brooklyn, N.Y. 11211

[21] Appl. No.: 12,784

[22] Filed: Feb. 5, 1987

[51] Int. Cl.[4] ..... B65D 33/16; B65D 91/00

[52] U.S. Cl. ..... 220/23.83; 232/32; 232/33; 383/5; 383/22; 383/74; 383/75

[58] Field of Search ..... 232/29–33; 383/5, 74, 75, 22, 25; 220/23.83

[56] References Cited

U.S. PATENT DOCUMENTS

| | | | |
|---|---|---|---|
| 121,646 | 12/1871 | McGrane | 383/25 |
| 209,233 | 10/1878 | Cox | 383/74 |
| 209,723 | 11/1878 | Stowell | 383/74 |
| 294,799 | 3/1884 | Lundy et al. | 383/74 |
| 426,746 | 4/1890 | Inwegen | 383/74 |
| 665,942 | 1/1901 | Tabler | 383/74 |
| 1,351,388 | 8/1920 | Kabaci | 383/74 |
| 2,263,346 | 11/1941 | Arne | 383/75 |
| 2,447,561 | 8/1948 | Brenner | 383/75 |
| 3,300,128 | 1/1967 | Jasinski | 232/17 |
| 4,290,548 | 9/1981 | Denhart | 232/17 |

*Primary Examiner*—Stephen P. Garbe

*Attorney, Agent, or Firm*—Goodman & Teitelbaum

[57] ABSTRACT

A security bag comprising a pouch with an open mouth. A strap passes through a sleeve disposed around the mouth. One end of the strap is secured to the pouch so that pulling the opposing free end of the strap gathers together the mouth to close the pouch. A clamp arrangement locks the strap to maintain the pouch in the closed position. An anchor is provided on the free end of the strap for insertion into a mailbox to be locked within the mailbox with the strap passing through a slit along the side edge of the mailbox. The mailman can place mail and the like in the pouch, seal the pouch with the clamp arrangement and depend the pouch from the locked mailbox.

16 Claims, 2 Drawing Sheets

MAILBOX SECURITY BAG

BACKGROUND OF THE INVENTION

This invention relates to a security bag, and more particularly to a bag which can be securely depended from a mailbox for storage of delivered letters, packages, and the like.

In apartment houses, post offices, and other locations, an individual mailbox is assigned to each resident. Generally, the mailboxes are small and as a result, all the delivered letters, small packages, magazines and the like, cannot be left in the mailbox. Therefore, when a package is to be delivered, the mailman may leave the package, as well as the excess letters that cannot fit in the mailbox, unsecured at a nearby location. This results in a situation which only tends to encourage tampering, robberies, and instrusion of the mail by unauthorized individuals.

Alternately, the mailman will leave a note requiring the resident to make a trip to the post office to pick up the excess letters and/or package. While this is more secure, it does result in an inconvenience, especially when people order magazines on a weekly or sometimes even daily basis.

There is accordingly, a need for the postman to be able to leave excess letters, packages, magazines and the like in a secure manner for only the resident to be able to pick up, and at the same time avoid the requirement of the postman to stuff the excess letters, packages, magazine, or the like in a crowded mailbox, where the excess letters, packages and magazine may not even be able to fit into the mailbox.

SUMMARY OF THE INVENTION

Accordingly, it is an object of the present invention to provide a security bag which can be used to avoid the aforementioned problem in the delivery of letters, packages, magazines and the like.

Another object of the present invention is to provide a security bag for containing letters, packages and the like, which can be closed and held depended from a mailbox.

Yet another object of the present invention is to provide a security bag for delivered mail having a pouch which can be closed with a one way closure and which can hang from the mailbox.

Still a further object of the present invention is to provide a security bag for delivered mail which can be carried by the postman or stored in an empty mailbox until utilized for the delivered mail.

A further object of the present invention is to provide a security bag for delivered mail which has a strap extending therefrom, the end of the strap being secured within the mailbox so that the security bag can depend from the mailbox.

Briefly, in accordance with the present invention, there is provided a security bag including a pouch with an open mouth. A one way closure device is provided for sealing the mouth of the pouch. A strap extends from the pouch adjacent to the mouth thereof, with an anchor being coupled to the end of the strap. The anchor has a particular configuration that can be locked within a mailbox while the strap extends out of the mailbox through a slit associated with the mailbox. In this manner, a postman can place the excess mail in the pouch, seal the pouch and then depend the pouch from the mailbox by means of the anchor which is locked within the mailbox.

In an embodiment of the present invention, the strap passes through a sleeve around the mouth of the pouch, one end of the strap being secured to the pouch. The free end of the strap has the anchor therein, which can be pulled tightly to gather the mouth of the pouch into a closed position. The closure device on the pouch engages the strap to lock it in place so that the pouch mouth is maintained in the closed position. The anchor at the free end of the strap is placed within the mailbox and the mailbox is closed so that the strap extends through a slit, which normally exists at the side of the mailbox between the mailbox cover and the mailbox receptacle, and the pouch hangs down from the mailbox.

The aforementioned objects, features and advantages of the invention will, in part, be pointed out with particularity, and will, in part, become obvious from the following more detailed description of the present invention, taken in conjunction with the accompanying drawings, which form an integral part thereof.

BRIEF DESCRIPTION OF THE DRAWINGS

In the drawings.

In the various figures of the drawing, like reference characters designate like parts.

DESCRIPTION OF THE PREFERRED EMBODIMENTS

Figure 1:
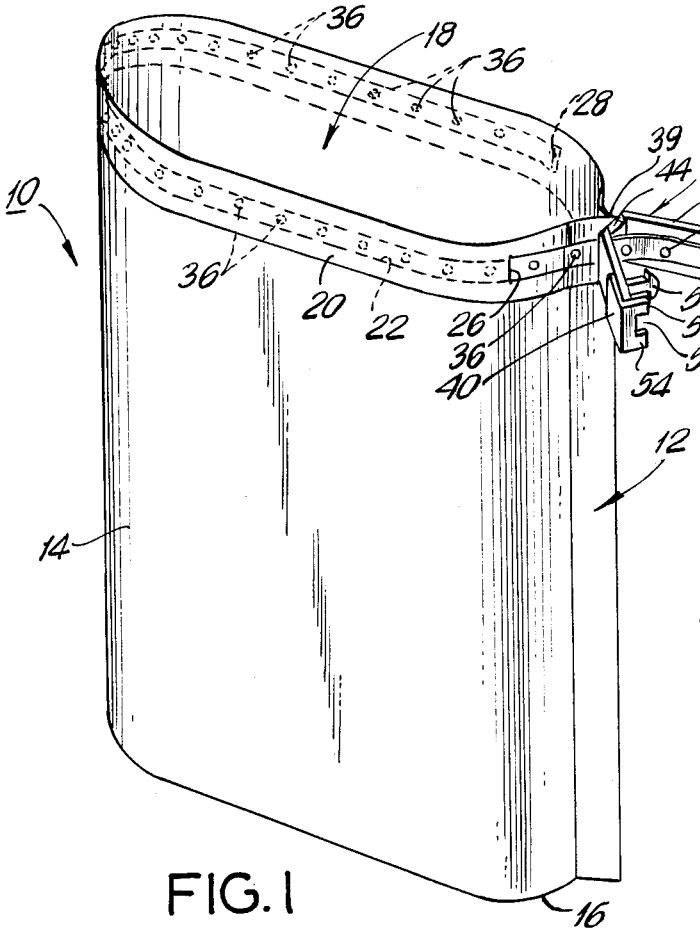
FIG. 1 is a perspective view of a security bag of the present invention in accordance with one embodiment thereof.
Figure 3:
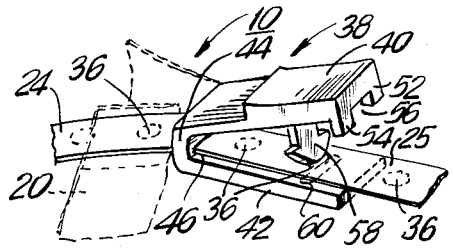
FIG. 3 is an enlarged perspective view of the clamping arrangement shown in the embodiment of FIG. 1.

Referring now to FIG. 1, there is shown a security bag 10 in accordance with the present invention, which can be used for receipt of mail, such as letters, packages, magazines, and the like delivered by a postman, when such mail is too large in amount or size for insertion into a mailbox, and thus is considered excess mail. The bag 10 includes an elongated pouch 12, which can typically be of a disposable type formed of plastic or other inexpensive and/or disposable material. The pouch 12 comprises peripheral walls 14 and a closed bottom 16. The top is open to provide a mouth 18. The upper edge is folded over to form a hem 20 which defines a sleeve 22 therein. A strap 24 is free to slidably move through the sleeve 22. An exit slit 26 is provided for the strap 24 to pass out of the sleeve 22.

Figure 4:
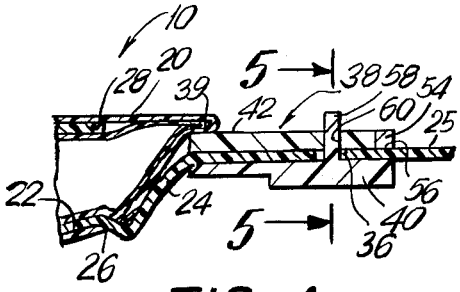
FIG. 4 is a cross sectional view taken along line 4—4 of FIG. 2, showing the operation of the clamp.

One end 28 of the strap 24 is secured within the sleeve 22 as shown in FIGS. 1 and 4. The opposite free end of the strap 24 is provided with an anchor 32 in the form of an enlarged head 34. As shown in FIG. 1, the enlarged head 34 has a flat, circular configuration, and is positioned transverse to the strap 24. The free end of the strap 24 passes through the anchor 32, and is secured by any well known means.

A plurality of perforations 36, preferably circular, are spaced along the strap 24 for engagement with a closure member or clamping arrangement 38 to close the pouch 12, as set forth below.

The clamping arrangement 38 can best be seen in FIGS. 1–5 as having a substantially U-shaped member including a pair of opposing hinged walls 40, 42 which are interconnected by a bight wall 44. A slot 46 in the bight wall 44 permits the body width portion 25 of the strap 24 to slidingly pass therethrough. The clamping arrangement 38 itself is secured at 39 to the pouch 12.

Figure 2:
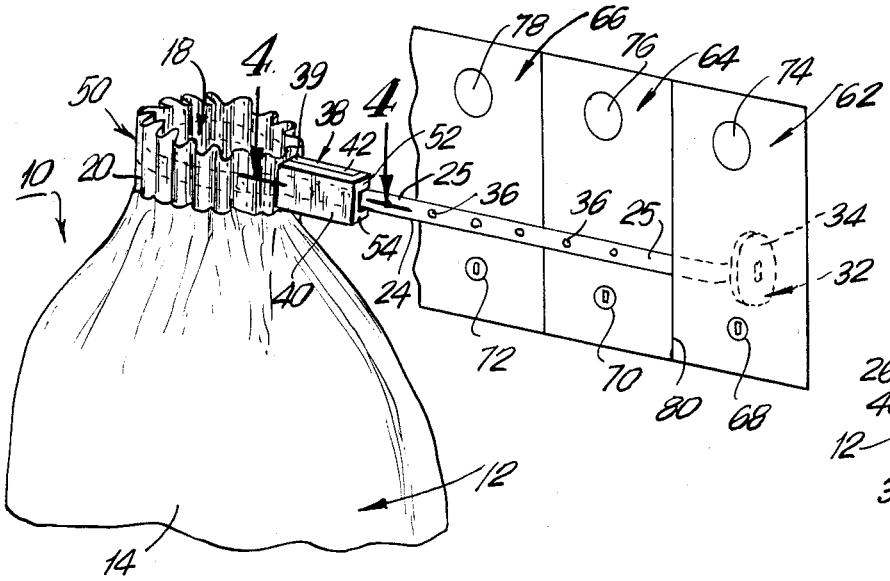
FIG. 2 is a fragmented perspective view showing the use of the security bag in its closed position with the anchor thereof locked within a mailbox so that the security bag depends from the mailbox.

As a result, as the body width portion 25 of the shape 24 is pulled through the sleeve 22, the mouth 18 will gather together, as shown at 50 in FIG. 2 to tightly close the top portion of the security bag 10.

The wall 40 of the clamping arrangement 38 includes a pair of opposing posts 52, 54 providing a guideway 56 therebetween for passage of the body width portion 25 of the strap 24 therethrough. A locking tab 58 having an arrowhead shaped free end portion extends from the inside of the wall 40 and the stem or tail portion of the locking tab 58 is matingly received within a slot 60 in the other wall 42, the slot 60 having a length equal to the width of the tail portion of the locking tab 58.

Figure 5:
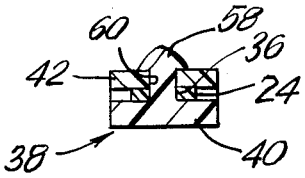
FIG. 5 is a cross sectional view taken along line 5—5 of FIG. 4, showing the insertion of the locking tab in the slot of the clamp.

As best seen in FIGS. 4 and 5, after the strap 24 has been pulled tightly through the slot 46 in the bight wall 44, a perforation 36 is positioned within the pair of opposing walls 40, 42. The opposing walls 40, 42 are clamped together so that the arrowhead of the locking tab 58 is pushed through the positioned perforation 36 in the strap 24, and continues to be forced through the slot 60 in the opposing wall 42. Because of the arrowhead arrangement, a one-way closure is provided whereby the arrowhead of the locking tab 58, which has a larger transverse width than the slot 60 as shown in FIG. 5, cannot be pulled back through the slot 60 of the wall 42. Thus, once the clamping arrangement 38 is closed, the only way to open the bag 10 would be to tear the bag 10 itself or cut off the clamping arrangement 38.

The operation and use of the device is best described in connection with FIG. 2. A series of mailboxes 62, 64, 66 are shown with each mailbox having a separate key 68, 70, 72. Typically, a small opening 74, 76, 78 is provided so that one can look in to see if mail is present in the mailbox.

When the mailman makes a delivery and should he have a large quantity of mail or mail, such as packages, too large to fit into the mailbox, he can have a bag 10 of the present type, and insert the excess mail or packages into the bag 10, and pull the free end of the strap 24 tight so that the mouth 18 closes. He then closes the one way clamping arrangement 38 so that the bag 10 is sealed.

The mailman then inserts the anchor 32 of the strap 24 into the mailbox 62 so that the strap 24 passes through a conventional side slit 80 between the edge of the mailbox cover and the side wall of the mailbox receptacle. The mailman then locks the mailbox 62 in the usual manner.

Although the strap 24 is thin enough to pass through the edge slit 80 of the mailbox 62, the enlarged head 34 of the anchor 32 will prevent extraction of the anchor 32 from the mailbox 62 without the proper authorized user opening the mailbox 62. The bag 10 will therefore depend in a locked manner from the mailbox 62 with the excess mail and/or packages contained therein. Obviously, the proper authorized user will also have to tear the bag 10, or cut off the clamping arrangement 38, in order to open the bag 10 to gain access to the mail within the bag 10.

The bag 10 could be printed with appropriate post office insignias and prominent warnings against tampering or instrusion. The bag 10 could be initially folded up and kept in the empty mailbox until it was needed. Alternately, the bags 10 might be carried by the mailman and dispensed by the mailman or sold at post offices. The construction of the bag 10 would be such that it could be disposed of after its one-time use.

Figure 6:
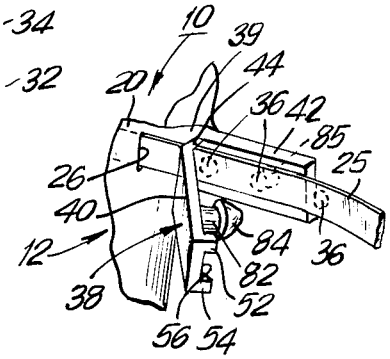
FIG. 6 is a fragmented perspective view of a clamp similar to that shown in FIG. 3, having a variation in the locking tab.

Referring now to FIG. 6, another embodiment of a clamping arrangement is shown, being similar to that previously described in connection with FIGS. 1–5. However, the locking tab is shown to have a circular stem 82 with an enlarged frustoconical tip 84, rather than the flattened arrowhead shown in the previous embodiment. Furthermore, the slot 60 in the wall 42 has been changed to a hole 85 to matingly receive the stem 82 which has the same diameter thereof.

Figure 7:
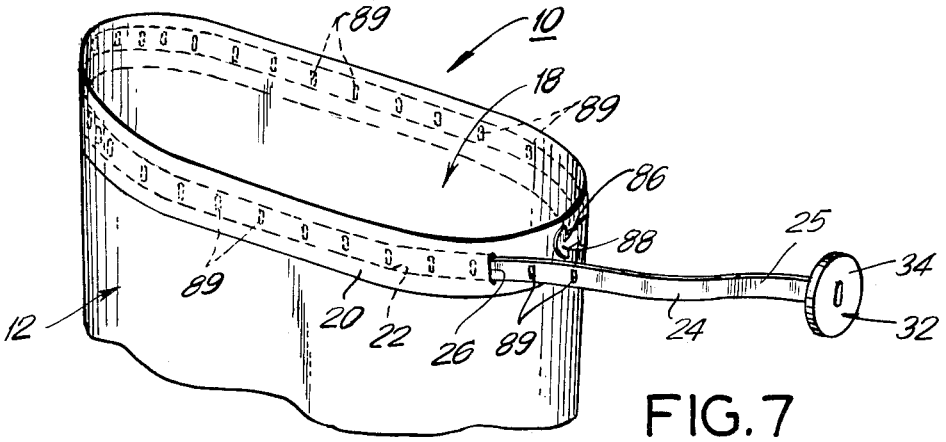
FIG. 7 is a fragmented perspective view of the top of the pouch, showing a different type of clamping arrangement to close the mouth of the pouch.
Figure 8:
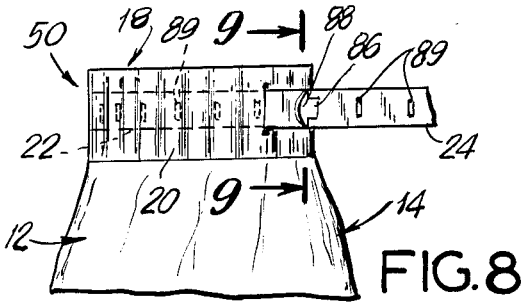
FIG. 8 is a fragmented elevational view of the top of the pouch shown in FIG. 7, showing the use of the clamping arrangement of FIG. 7.
Figure 9:
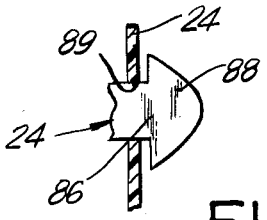
FIG. 9 is a fragmented cross sectional view taken along line 9—9 of FIG. 8, showing the insertion of the locking tab into a perforation in the strap.

Other types of clamping arrangements could be utilized as well. For example, in FIG. 7, the end 86 of the strap 24 includes an arrowhead 88 formed directly on the strap 24. The strap 24 adjacent the arrowhead 88 is secured in place onto the bag 10. In order to close the bag 10, the body width portion 25 of the strap 24 is pulled through the sleeve 22 until the mouth 18 is gathered into the closed position 50, as shown in FIG. 8. At that point, the arrowhead 88 is forced directly through one of the perforations 89 contained in the strap 24 to close and lock the upper end of the bag 10. The perforations 89 have a length equal to the width of the stem or tail portion of the arrowhead 88 to matingly receive same, where the arrowhead tip portion has a larger transverse width, as shown in FIG. 9, so that the arrowhead tip portion cannot be pulled back through the perforation 89.

Figure 10:
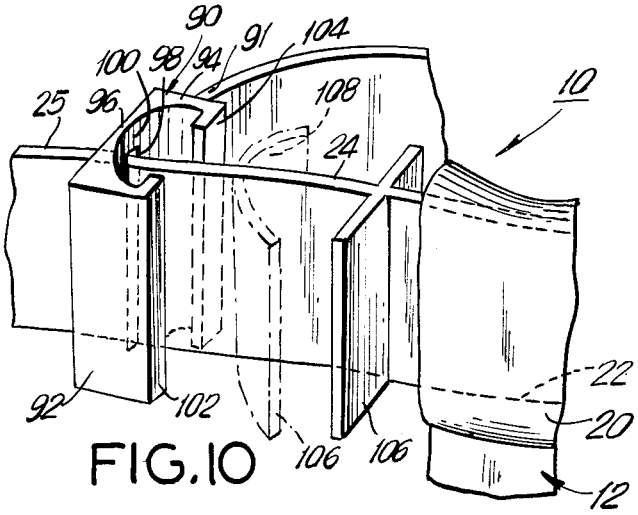
FIG. 10 is a fragmented perspective view of another type of clamping arrangement for closing the pouch.
Figure 11:
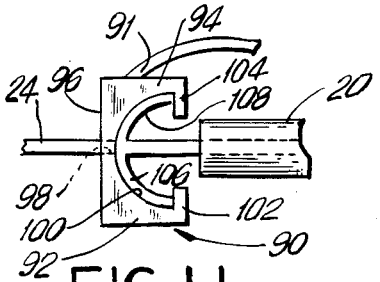
FIG. 11 is a fragmented top view, showing the clamp of FIG. 10 in its closed position.

A further clamping arrangement is shown in FIGS. 10 and 11. In this case, a substantially U-shaped member 90 is secured on the outer wall 91 of the hem 20 of the bag 10. The U-shaped member 90 includes a pair of opposing side walls 92, 94 with a back wall 96. A slot 98 is formed in the back wall 96 to allow passage therethrough of the body width portion 25 of the strap 24. The back wall 96 includes an inner surface 100 which is arcuate in shape. Each of the side walls 92, 94 includes inwardly directed front facing walls 102, 104 which are opposingly directed toward each other and spaced apart from each other. Positioned along the strap 24 is a transverse flange 106 formed of flat, semi-flexible material.

The strap 24 is pulled so that it gathers together the mouth 18 of the bag to close off the mouth 18. At that position, the flat plate 106 is forced into the space between the opposing front walls 102, 104 of the housing 90 so that the plate 106 is forced into an acuate shape 108, as shown in dotted lines in FIG. 10. In this shape 108, the plate 106 snaps into place against the arcuate inner surface 100 beneath the opposing walls, 102, 104, as shown in FIG. 11, and secures the bag 10 closed. Once closed, the one way closure would require ripping open of the bag 10 in order to gain access to the contents within the bag 10, where the walls 102, 104 will not release the plate 106 from the clamp member 90.

Figure 12:
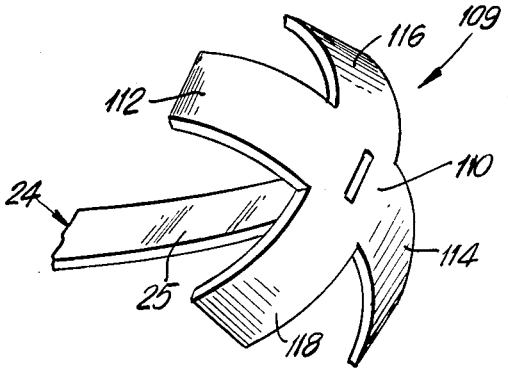
FIG. 12 is a fragmented perspective view, showing another embodiment of the anchor at the end of the strap.

The anchors could be of various shapes. By way of example, FIG. 12 shows an anchor 109 having an outer crown 110 with a plurality of outwardly directed, arcuate arms 112, 114, 116, 118 in the form of an umbrella. Such type of anchor 109 would remain secured within the mailbox and could not be pulled out even upon yanking on the end of the strap 24.

Figure 13:
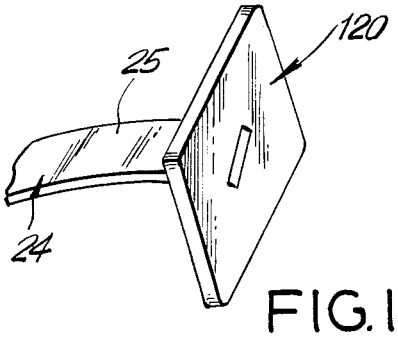
FIG. 13 is a fragmented perspective view showing a further embodiment of the anchor at the end of the strap.

A further anchor 120 is shown in FIG. 13, which is similar to that of FIG. 1 except the shape of the anchor 120 need not be round as heretofore described, but could be any shape, such as square, rectangular diamond shape.

It is noted, that the security bag 10 of the present invention is fabricated from a thin, strong, plastic film material so that it is capable of being folded into a small compact unit. This is considered an important feature of the present invention, where the small compact unit does not take up much space, and, therefore, this small compact unit can be left in the mailbox, or can be conveniently carried in the mailman's bag.

There has been disclosed heretofore the best embodiments of the invention presently contemplated. However, it is to be understood, that various changes and modifications may be made thereto without departing from the spirit of the present invention.

What is claimed is:

1. A security bag comprising a pouch with an open mouth; a closure member for sealing said mouth of said pouch; a strap extending from said pouch; and an anchor coupled to a distal end of said strap; said anchor being of a size to be locked within a mailbox with said strap extending to an exterior through a slit associated with the mailbox; such that a postman can deliver mail and the like into said pouch, seal said pouch and depend said pouch from the mailbox by means of said anchor locked within the mailbox; said strap extending about said mouth of said pouch to close said pouch; a folded over hem being provided about said mouth of said pouch to provide a sleeve for receiving said strap; and an exit from said sleeve being provided through which said strap passes so that said strap can slide through said sleeve; said strap being secured to said pouch at one point; a first end of said strap being opposite said distal end of said strap; said first end of said strap being secured to said pouch at said hem; said distal end being free, whereby pulling of said distal end gathers said mouth of said pouch to seal said mouth and close said pouch.

2. A security bag as in claim 1, wherein said anchor has an enlarged head.

3. A security bag as in claim 1, wherein a plurality of spaced perforations are provided along a length of said strap, and said closure member includes a one way insert member for insertion into a selected one of said perforations.

4. A security bag as in claim 3, wherein said one way insert member is arrow shaped and secured to said pouch.

5. A security bag as in claim 3, wherein said closure member includes a U-shaped clamp having opposed hinged walls interconnected by a bight portion, said strap passing through a slit in said bight portion, said clamp walls defining a guideway along which said strap passes, said one way insert member being a piercing tab projecting from one of said clamp walls, a mating receiving slot provided in the opposing clamp wall, said piercing tab passing through said selected one perforation and locking into said receiving slot for securing said pouch closed.

6. A security bag as in claim 5, wherein said piercing tab is flat and has a head larger than said receiving slot.

7. A security bag as in claim 5, wherein said piercing tab is round and has a head larger than said receiving slot.

8. A security bag as in claim 5, and wherein said clamp is secured to said pouch.

9. A security bag as in claim 1, wherein said closure member includes a U-shaped clamp housing secured to said pouch, a back wall of said clamp housing being arcuately shaped, a slit provided in said back wall through which said strap can slide, and a flat semi-flexible flange positioned along said strap for bent entry into said clamp housing against said back wall whereupon it becomes trapped in said clamp housing to close the pouch.

10. A security bag as in claim 9, wherein said clamp housing includes spaced apart front facing walls to secure said flange within said clamp housing.

11. A security bag as in claim 1, wherein said anchor includes an enlarged head at said distal end of said strap.

12. A security bag comprising a pouch with an open mouth; a closure member for sealing said mouth of said pouch; a strap extending from said pouch; and an anchor coupled to a distal end of said strap; said anchor being of a size to be locked within a mailbox with said strap extending to an exterior through a slit associated with the mailbox; such that a postman can deliver mail and the like into said pouch, seal said pouch and depend said pouch from the mailbox by means of said anchor locked within the mailbox; said closure member including one way clamp means for maintaining said mouth of said pouch in a sealed condition so that once said clamp means is closed, said clamp means will not reopen.

13. A security bag as in claim 12, wherein said clamp means includes a locking tab having an arrowhead shaped free end portion.

14. A security bag comprising a pouch with an open mouth; a closure member for sealing said mouth of said pouch; a strap extending from said pouch; and an anchor coupled to a distal end of said strap; said anchor being of a size to be locked within a mailbox with said strap extending to an exterior through a slit associated with the mailbox; such that a postman can deliver mail and the like into said pouch, seal said pouch and depend said pouch from the mailbox by means of said anchor locked within the mailbox; said anchor including an enlarged head at said distal end of said strap; said enlarged head being a flat flange transverse to said strap.

15. A security bag comprising a pouch with an open mouth; a closure member for sealing said mouth of said pouch; a strap extending from said pouch; and an anchor coupled to a distal end of said strap; said anchor being of a size to be locked within a mailbox with said strap extending to an exterior through a slit associated with the mailbox; such that a postman can deliver mail and the like into said pouch, seal said pouch and depend said pouch from the mailbox by means of said anchor locked within the mailbox; said anchor including an enlarged head at said distal end of said strap; said enlarged head having a forward crown with a number of rearwardly directed, outwardly flared arms.

16. A security bag comprising a pouch with an open mouth; a closure member for sealing said mouth of said pouch; a strap extending from said pouch; and an anchor coupled to a distal end of said strap; said anchor being of a size to be locked within a mailbox with said strap extending to an exterior through a slit associated with the mailbox; such that a postman can deliver mail and the like into said pouch, seal said pouch and depend said pouch from the mailbox by means of said anchor locked within the mailbox; said strap passing through said slit between the mailbox and a mailbox receptacle.

* * * * *